US011242969B2

(12) United States Patent
Sheng

(10) Patent No.: US 11,242,969 B2
(45) Date of Patent: Feb. 8, 2022

(54) FLAME-SHAPED CHIP AND FLAMELESS CANDLE

(71) Applicant: FOSHAN INNOVATION AND QUALITY ELECTRONIC TECHNOLOGY CO., LTD., Guangdong (CN)

(72) Inventor: Guangrun Sheng, Guangdong (CN)

(73) Assignee: FOSHAN INNOVATION AND QUALITY ELECTRONIC TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/090,342

(22) PCT Filed: Jun. 8, 2016

(86) PCT No.: PCT/CN2016/085181
§ 371 (c)(1),
(2) Date: Oct. 1, 2018

(87) PCT Pub. No.: WO2017/166433
PCT Pub. Date: Oct. 5, 2017

(65) Prior Publication Data

US 2019/0113195 A1 Apr. 18, 2019

(30) Foreign Application Priority Data

Mar. 29, 2016 (CN) ..... 201620249960.6

(51) Int. Cl.
*F21S 10/04* (2006.01)
*F21S 6/00* (2006.01)
*F21W 121/00* (2006.01)

(52) U.S. Cl.
CPC ..... *F21S 10/046* (2013.01); *F21S 6/001* (2013.01); *F21S 10/04* (2013.01); *F21W 2121/00* (2013.01)

(58) Field of Classification Search
CPC ..... F21S 10/046; F21S 6/001; F21S 10/04; F21W 2121/00
See application file for complete search history.

(56) References Cited

U.S. PATENT DOCUMENTS

2014/0218903 A1* 8/2014 Sheng ..... F21S 10/046 362/190
2016/0116126 A1* 4/2016 Johannsson ..... F21S 10/046 362/296.01

(Continued)

OTHER PUBLICATIONS

Hu, Chinese Patent Application CN203784814, Machine Translation (Year: 2014).*

*Primary Examiner* — Tracie Y Green
(74) *Attorney, Agent, or Firm* — JCIP Global Inc.

(57) ABSTRACT

The invention provides a flame-shaped chip, characterized by comprising an upper flame-shaped piece, an umbrella and a needle. The umbrella is arranged at the bottom of the upper flame-shaped piece and used for covering, and the needle is arranged in the umbrella as the umbrella rod. The needle and the umbrella are integrally or separately arranged. The flame-shaped chip is convenient to assemble and disassemble. The invention also provides a flameless candle, wherein the flameless candle comprises a flame-shaped chip and a candle-shaped housing. The flame-shaped chip comprises an upper flame-shaped piece, an umbrella and a needle. The umbrella is arranged at the bottom of the upper flame-shaped piece and used for covering, and the needle is arranged in the umbrella as the umbrella rod. The needle and the umbrella are integrally or separately arranged, and the needle is arranged on and/or contacts with the housing.

8 Claims, 4 Drawing Sheets

(56) References Cited

U.S. PATENT DOCUMENTS

| | | | | |
|---|---|---|---|---|
| 2016/0298816 | A1* | 10/2016 | Fang | F21S 10/046 |
| 2017/0023196 | A1* | 1/2017 | Li | F21S 10/046 |
| 2018/0283633 | A1* | 10/2018 | Roberts | F21S 10/04 |
| 2019/0186705 | A1* | 6/2019 | Roberts | F21S 10/04 |

* cited by examiner

FLAME-SHAPED CHIP AND FLAMELESS CANDLE

FIELD OF THE INVENTION

The invention relates to the decorative lighting technical field, or more specifically, a flame-shaped chip and flameless candle.

BACKGROUND OF THE INVENTION

The traditional candle is a kind of daily lighting tools. It is made of paraffin wax and can burn to give off light. Candles have important uses in birthday parties, religious festivals and other activities. At present, there is a kind of electronic flameless candle on the market, which simulates the light of candles through switch control, blow control, remote control and other control methods. This kind of electronic flameless candle is getting more and more popular on the market. It can be used in romantic, sentimental appeal, sweet, and happy times and festivals, meeting the special demands of festivals and household articles for people at all levels.

When assembling the existing electronic flameless candle, first fix the flame-shaped chip inside the candle, and then wrap the candle-shaped housing through the flame-shaped chip through the central opening to finish the assembly. As the existing flameless candle adopts the above assembly mode, the opening in housing is large, at least larger than the flame-shaped chip, resulting that the internal structure of the assembled candle can be seen from the opening. This affects the overall appearance of the candle and is unfavorable to protecting the internal structure, meaning that there is a great space for improvement.

SUMMARY OF THE INVENTION

The invention aims to overcome the shortcomings of existing technology and provides a kind of flame-shaped chip conducive to protect the internal structure and convenient to assemble and disassemble, so as to realize more vivid and realistic candle simulation. This invention also provides a kind of flameless candle with good simulation effect and protection of internal structure.

In order to achieve the above purpose, the invention shall be implemented through the following technical solution: A flame-shaped chip, characterized by comprising an upper flame-shaped piece, an umbrella and a needle. The umbrella is arranged at the bottom of the upper flame-shaped piece and used for covering, and the needle is arranged in the umbrella as the umbrella rod. The needle and the umbrella are integrally or separately arranged.

In above solution, the flame-shaped chip of invention can be independently set in the product using it through the needle arranged in the umbrella as the umbrella rod, so as to simplify the assembly and disassembly and become convenient to use and replace. When using, the umbrella of flame-shaped chip can be used as a shelter, so as to improve the overall appearance and protect the internal structure.

The needle is big end up or vice versa. The thinner end serves as the fulcrum for swinging of the flame-shaped chip. The needle can flexibly combine with the umbrella, to realize upper support or lower support of umbrella.

A flameless candle comprises a flame-shaped chip and a candle-shaped housing. The flame-shaped chip comprises an upper flame-shaped piece, an umbrella and a needle. The umbrella is arranged at the bottom of the upper flame-shaped piece and used for covering, and the needle is arranged in the umbrella as the umbrella rod. The needle and the umbrella are integrally or separately arranged, and the needle is arranged on and/or contacts with the housing. The highest point of the needle is higher than the lowest point of the top end face of the housing. The upper piece and the umbrella are combined with the housing from the upper portion of the housing through the needle.

In above solution, as the highest point of the needle is higher than the lowest point of the top end face of the housing, the assembly sequence of the flameless candle is: first assemble the candle-shaped housing, and then combine the flame-shaped chip with the housing from the upper portion of the housing through the needle. This assembly method is not only simple and convenient, without needing to considering the size of opening in housing and even don't need to open an opening on the housing for flame-shaped chip when there is no power drive; also, the umbrella of flame-shaped chip can cover the housing to be used as a shelter, so the internal structure of flameless candle is invisible from outside, thus improving the overall appearance and protecting the internal structure. The invention design can shake or swing irregularly in all directions under the action of natural wind or external force.

The needle is arranged on and/or contacts with the top end face of the housing.

The top end face of the housing has a socket portion contacting with the needle. The needle and the umbrella are integrally formed. The end of the needle, away from the umbrella, serves as the fulcrum for swinging of the flame-shaped chip. The socket portion is provided with a recess matched with the end of the needle distant from the umbrella.

The top end face of the housing has a socket portion contacting with the bottom of the needle. The needle and the umbrella are separately formed. The end of the needle, connected with the umbrella, serves as the fulcrum for swinging of the flame-shaped chip.

The needle of the invention can serve as the fulcrum for swinging of the flame-shaped chip by one of above two methods: when the needle contacts with the top end face of the housing, then the needle serves as the fulcrum for swinging of the flame-shaped chip by way of lower support; when the needle is arranged on the top end face of the housing, then the needle serves as the fulcrum for swinging of the flame-shaped chip by way of upper support. The flame-shaped chip is assembled by above two methods, which simplify the assembly and disassembly process and are easy to use or replacement.

The flame-shaped chip comprises a connector arranged below the umbrella and connected with the swinging mechanism. The top end face of the housing is provided with a slot allowing the connector to be inserted into the housing from the upper portion.

The swinging mechanism comprises a driving device and a driven device. The connector is connected with the driven device.

The swinging mechanism may be structured in one of the following ways:

(1) A magnet is arranged at the bottom of the driven device. The driving device is an induction coil, which is arranged on the electric board and generates magnetic field. The induction coil is opposite to the magnet of the driven device. Two ends of the induction coil are electrically connected with the control circuit;

(2) The driving device is a rotary disc, which is driven to horizontally rotate by a transmission shaft or a drive unit.

The rotary disc is provided with a lever for triggering the driven device. The drive unit is arranged in the housing;

(3) The driving device is a rotary column, which is driven to horizontally rotate by a transmission shaft or a drive unit and used for touching the driven device. The drive unit is arranged in the housing;

(4) The driving device is a fan, and an air outlet of the fan is arranged at the bottom of the driven device;

(5) The bottom of the driven device is provided with a magnet, and the driving device is a primary magnet device. The primary magnet device comprises a link piece, an upper magnet, a lower magnet, and an induction coil, wherein the upper magnet and the lower magnet are arranged at the upper end and the lower end of the link piece respectively, and the induction coil is arranged on the electric board and generates magnetic field. The induction coil is opposite to the lower magnet of the link piece, and two ends of the induction coil are electrically connected with the control circuit.

The housing is provided with a hole allowing light to pass directly and irradiate the flame-shaped chip.

Compared with the existing technology, the invention has the following advantages and beneficial effects:

The flame-shaped chip of invention is easy to assemble and disassemble, and can protect the internal structure, so as to realize more vivid and realistic simulation of candles.

The invention of flameless candle has good candle simulation effect and makes the internal structure of the flameless candle invisible from outside, so as to improve the overall appearance and protect the internal structure.

DETAILED DESCRIPTION OF THE PREFERRED EMBODIMENTS

The following text gives a further description of the invention by combining with the figures and specific implementation modalities.

Example 1

This example describes the invention when the needle serves as the fulcrum for swinging of the flame-shaped chip by way of lower support.

Figure 1:
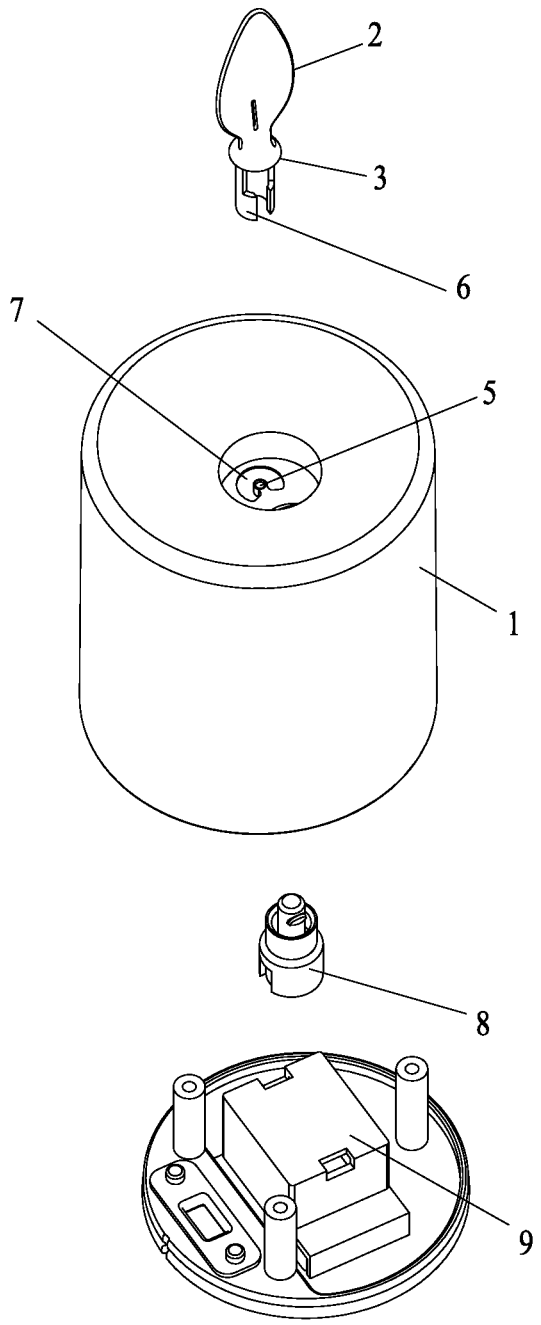
FIG. 1 is the exploded view of flameless candle in example 1.
Figure 2:
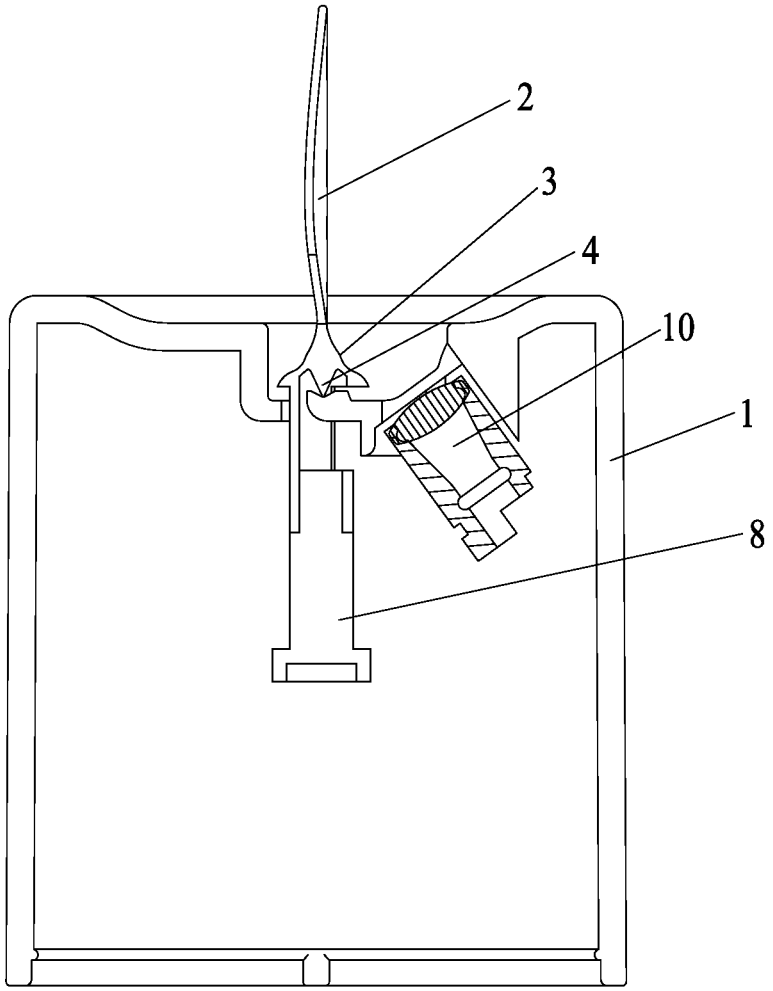
FIG. 2 is the internal schematic diagram of flameless candle in example 1.

As shown in FIG. 1 and FIG. 2, the invention of flameless candle comprises of a flame-shaped chip and candle-shaped housing, wherein the flame-shaped chip includes an upper flame-shaped piece (2), an umbrella (3) and a needle (4). The umbrella (4) is arranged at the bottom of the upper flame-shaped piece (2) and used for covering, and the needle (4) is arranged in the umbrella (4) as the umbrella rod. The needle (4) and the umbrella (3) are integrally or separately arranged. The needle (4) is big end up or vice versa. The thinner end serves as the fulcrum for swinging of the flame-shaped chip by contacting with the top end face of the housing (1). The highest point of the needle (4) is higher than the lowest point of the top end face of the housing (1). The upper piece (2) and the umbrella (3) are combined with the housing (1) from the upper portion of the housing (1) through the needle (4).

The top end face of the housing (1) has a socket portion contacting with the needle (4). The needle (4) and the umbrella (3) are integrally formed. The end of the needle (4), away from the umbrella (3), serves as the fulcrum for swinging of the flame-shaped chip. The socket portion is provided with a recess (5) matched with the end of the needle (4) distant from the umbrella (3).

The flame-shaped chip comprises a connector (6) arranged below the umbrella (3) and connected with the swinging mechanism. The top end face of the housing (1) is provided with a slot (7) allowing the connector (6) to be inserted into the housing (1) from the upper portion.

The swinging mechanism comprises a driving device and a driven device (8). The connector (6) is connected with the driven device (8), wherein a magnet is arranged at the bottom of the driven device (8). The driving device is an induction coil (9), which is arranged on the electric board and generates magnetic field. The induction coil (9) is opposite to the magnet of the driven device (8). Two ends of the induction coil (9) are electrically connected with the control circuit;

The housing (1) is provided with a hole allowing light (10) to pass directly and irradiate the flame-shaped chip.

The assembly sequence of the flameless candle is: first assemble the candle-shaped housing (1), then combine the flame-shaped chip with the housing (1) from the upper portion of the housing (1) through the needle (4). This assembly method is not only simple and convenient, without needing to considering the size of opening in housing (1); also, the umbrella (3) of flame-shaped chip can cover the housing (1) to be used as a shelter, so the internal structure of flameless candle is invisible from outside, thus improving the overall appearance and protecting the internal structure. The flame-shaped chip of invention can be independently set in the flameless candle using it through the needle (4) arranged in the umbrella (3) as the umbrella rod, so the flame simulation device can well present the flame swinging in the process of candle burning, generating more realistic "flame" effect.

Example 2

This example describes the invention when the needle serves as the fulcrum for swinging of the flame-shaped chip by way of upper support.

Figure 3:
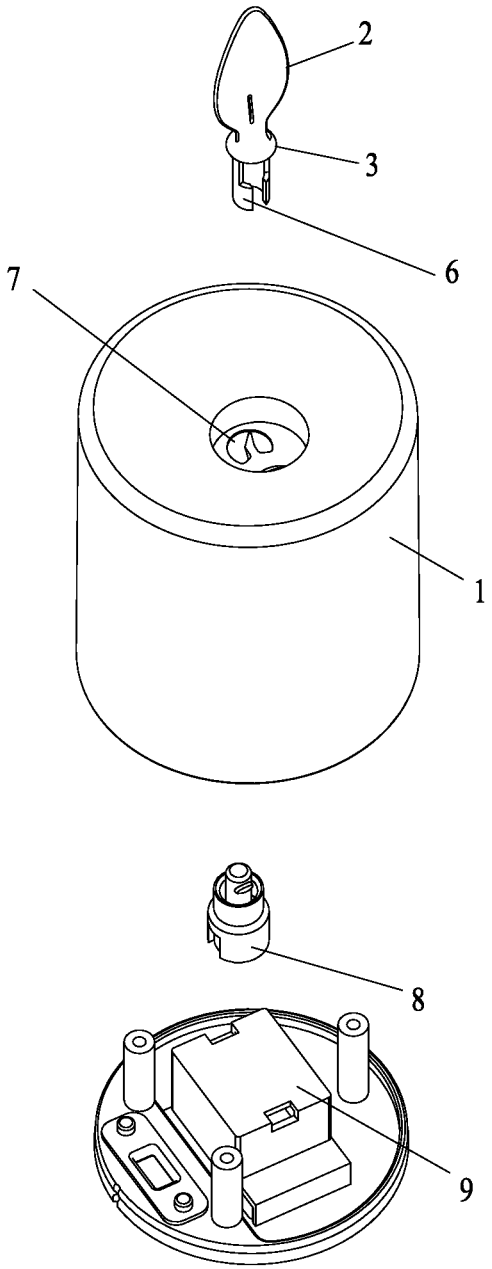
FIG. 3 is the exploded view of flameless candle in example 2.
Figure 4:
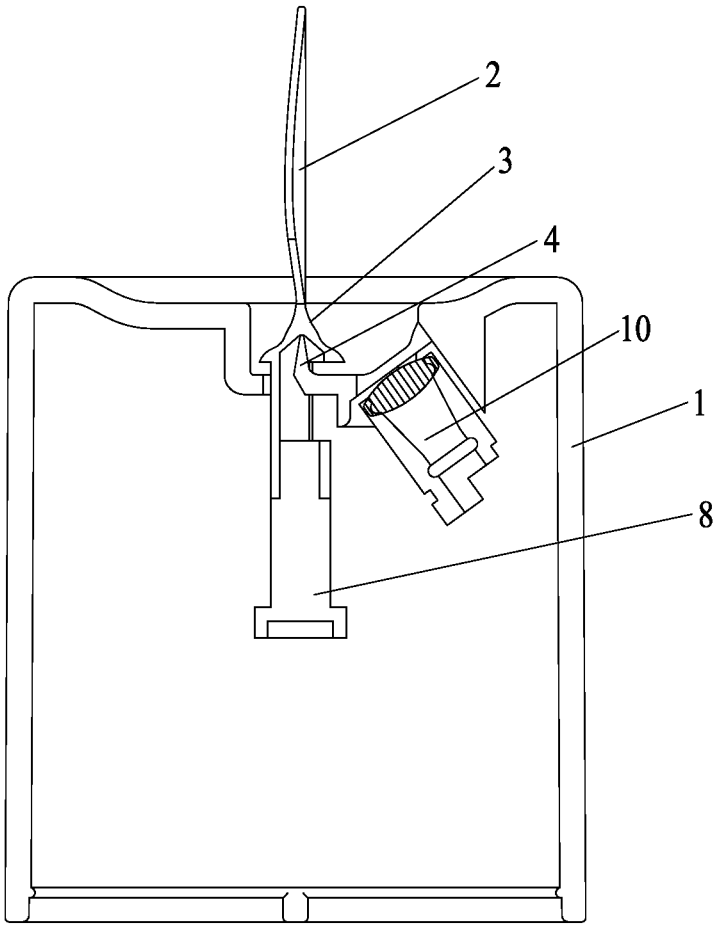
FIG. 4 is the internal schematic diagram of flameless candle in example 2.

As shown in FIG. 3 and FIG. 4, the invention of flameless candle comprises of a flame-shaped chip and candle-shaped housing, wherein the flame-shaped chip includes an upper flame-shaped piece (2), an umbrella (3) and a needle (4). The umbrella (4) is arranged at the bottom of the upper flame-shaped piece (2) and used for covering, and the needle (4) is arranged in the umbrella (4) as the umbrella rod. The needle (4) and the umbrella (3) are separately arranged, and the needle (4) is arranged on the top end face of the housing (1). The needle (4) is thinner end up and the thinner end serves as the fulcrum for swinging of the flame-shaped chip. The highest point of the needle (4) is higher than the lowest point of the top end face of the housing (1). The upper piece (2) and the umbrella (3) are combined with the housing (1) from the upper portion of the housing (1) through the needle (4).

The top end face of the housing (1) has a socket portion contacting with the bottom of the needle (4). The needle (4) and the umbrella (3) are separately formed. The end of the needle (4), connected with the umbrella (3), serves as the fulcrum for swinging of the flame-shaped chip.

The flame-shaped chip comprises a connector (6) arranged below the umbrella (3) and connected with the swinging mechanism. The top end face of the housing (1) is provided with a slot (7) allowing the connector (6) to be inserted into the housing (1) from the upper portion.

The swinging mechanism comprises a driving device and a driven device (8). The connector (6) is connected with the driven device (8), wherein a magnet is arranged at the bottom of the driven device (8). The driving device is an induction coil (9), which is arranged on the electric board and generates magnetic field. The induction coil (9) is opposite to the magnet of the driven device (8). Two ends of the induction coil (9) are electrically connected with the control circuit;

The housing (1) is provided with a hole allowing light (10) to pass directly and irradiate the flame-shaped chip.

The assembly sequence of the flameless candle is: first assemble the candle-shaped housing (1), then combine the flame-shaped chip with the housing (1) from the upper portion of the housing (1) through the needle (4). This assembly method is not only simple and convenient, without needing to considering the size of opening in housing (1); also, the umbrella (3) of flame-shaped chip can cover the housing (1) to be used as a shelter, so the internal structure of flameless candle is invisible from outside, thus improving the overall appearance and protecting the internal structure. The flame-shaped chip of invention can be independently set in the flameless candle using it through the needle (4) arranged in the umbrella (3) as the umbrella rod, so the flame simulation device can well present the flame swinging in the process of candle burning, generating more realistic "flame" effect.

Example 3

The difference between this example and example 1 only lies in that: the structure of swinging mechanism is different.

The swinging mechanism may be structured in one of the following ways:

(1) The driving device is a rotary disc, which is driven to horizontally rotate by a transmission shaft or a drive unit. The rotary disc is provided with a lever for triggering the driven device. The drive unit is arranged in the housing;

(2) The driving device is a rotary column, which is driven to horizontally rotate by a transmission shaft or a drive unit and used for touching the driven device. The drive unit is arranged in the housing;

(3) The driving device is a fan, and an air outlet of the fan is arranged at the bottom of the driven device;

(4) The bottom of the driven device is provided with a magnet, and the driving device is a primary magnet device. The primary magnet device comprises a link piece, an upper magnet, a lower magnet, and an induction coil, wherein the upper magnet and the lower magnet are arranged at the upper end and the lower end of the link piece respectively, and the induction coil is arranged on the electric board and generates magnetic field. The induction coil is opposite to the lower magnet of the link piece, and two ends of the induction coil are electrically connected with the control circuit.

Other structures of flameless candle in this example shall refer to example 1 or same with example 1.

Example 4

The difference between this example and example 1 only lies in that: it doesn't include the connector and the swinging mechanism.

The invention of flameless candle comprises of a flame-shaped chip and candle-shaped housing, wherein the flame-shaped chip includes an upper flame-shaped piece, an umbrella and a needle. The umbrella is arranged at the bottom of the upper flame-shaped piece and used for covering, and the needle is arranged in the umbrella as the umbrella rod. The needle and the umbrella are integrally or separately arranged. The needle is big end up or vice versa. The thinner end serves as the fulcrum for swinging of the flame-shaped chip by contacting with the top end face of the housing. The highest point of the needle is higher than the lowest point of the top end face of the housing. The upper flame-shaped piece and the umbrella are combined with the housing from the upper portion of the housing through the needle.

The top end face of the housing has a socket portion contacting with the needle. The needle and the umbrella are integrally formed. The end of the needle, away from the umbrella, serves as the fulcrum for swinging of the flame-shaped chip. The socket portion is provided with a recess matched with the end of the needle distant from the umbrella.

The invention design can shake or swing irregularly in all directions under the action of natural wind.

Example 5

The difference between this example and example 2 only lies in that: it doesn't include the connector and the swinging mechanism.

The invention of flameless candle comprises of a flame-shaped chip and candle-shaped housing, wherein the flame-shaped chip includes an upper flame-shaped piece, an umbrella and a needle. The umbrella is arranged at the bottom of the upper flame-shaped piece and used for covering, and the needle is arranged in the umbrella as the umbrella rod. The needle and the umbrella are separately arranged, and the needle is arranged on the top end face of the housing. The needle is thinner end up and the thinner end serves as the fulcrum for swinging of the flame-shaped chip. The highest point of the needle is higher than the lowest point of the top end face of the housing. The upper flame-shaped piece and the umbrella are combined with the housing from the upper portion of the housing through the needle.

The top end face of the housing has a socket portion contacting with the bottom of the needle. The needle and the umbrella are separately formed. The end of the needle, connected with the umbrella, serves as the fulcrum for swinging of the flame-shaped chip.

The invention design can shake or swing irregularly in all directions under the action of natural wind.

The above examples are good practices of the invention; however, the practice of the invention is not restricted by above examples, and any other changes, modifications, replacements, combinations and simplifications within the spirit and principles of the invention shall be regarded as equivalent replacement and included in the protection scope of the invention.

What is claimed is:

1. A flame-shaped chip, comprising an upper flame-shaped piece, an umbrella and a needle, wherein the umbrella is arranged at a bottom of the upper flame-shaped piece and used for sheltering, the needle is arranged in a central portion of the umbrella as an umbrella rod, and the needle is entirely covered by the umbrella, and the needle and the umbrella are integrally arranged, wherein the whole needle is cone-shaped and has an upper bigger end and a lower thinner end away from the umbrella, and the lower thinner end is a conical tip and serves as a fulcrum for swinging of the flame-shaped chip.

2. A flameless candle, wherein the flameless candle comprises a flame-shaped chip and a candle-shaped housing; the flame-shaped chip comprises an upper flame-shaped piece, an umbrella and a needle, the umbrella is arranged at a bottom of the upper flame-shaped piece and used for sheltering an internal structure arranged in the housing, and the needle is arranged in a central portion of the umbrella as an umbrella rod, and the needle is entirely covered by the umbrella, the needle and the umbrella are integrally formed, and a highest point of the needle is higher than a lowest point of a top end face of the housing, the upper flame-shaped piece and the umbrella are combined with the housing from the top end face of the housing through the needle, wherein the whole needle is cone-shaped and has an upper bigger end and a lower thinner end away from the umbrella, and the lower thinner end is a conical tip in contact with the housing, and serves as a fulcrum for swinging of the flame-shaped chip.

3. The flameless candle according to claim 2, wherein the needle is arranged on and contacts the top end face of the housing.

4. The flameless candle according to claim 3, wherein the top end face of the housing has a socket portion contacting the needle, and the socket portion is provided with a recess matched with the lower thinner end of the needle distant from the umbrella.

5. The flameless candle according to claim 4, wherein the flame-shaped chip comprises a connector arranged below the umbrella and connected with a swinging mechanism, the top end face of the housing is provided with a slot allowing the connector to be inserted into the housing from the upper portion.

6. The flameless candle according to claim 5, wherein the swinging mechanism comprises a driving device and a driven device, the connector is connected with the driven device.

7. The flameless candle according to claim 5, wherein the swinging mechanism is structured in one of the following ways:

(1) a magnet is arranged at a bottom of the driven device, the driving device is an induction coil, which is arranged on an electric board and generates magnetic field, the induction coil is opposite to the magnet of the driven device, two ends of the induction coil are electrically connected with a control circuit;

(2) the driving device is a rotary disc, which is driven to horizontally rotate by a transmission shaft or a drive unit, the rotary disc is provided with a lever for triggering the driven device, the drive unit is arranged in the housing;

(3) the driving device is a rotary column, which is driven to horizontally rotate by a transmission shaft or a drive unit and used for touching the driven device, the drive unit is arranged in the housing;

(4) the driving device is a fan, and an air outlet of the fan is arranged at the bottom of the driven device;

(5) the bottom of the driven device is provided with the magnet, and the driving device is a primary magnet device, the primary magnet device comprises a link piece, an upper magnet, a lower magnet, and an induction coil, wherein the upper magnet and the lower magnet are arranged at an upper end and a lower end of the link piece respectively, and the induction coil is arranged on the electric board and generates magnetic field, the induction coil is opposite to the lower magnet of the link piece, and two ends of the induction coil are electrically connected with the control circuit.

8. The flameless candle according to claim 2, wherein the housing is provided with a hole allowing light to pass directly and irradiate the flame-shaped chip.

* * * * *